US010359179B2

(12) United States Patent
Ozawa et al.

(10) Patent No.: US 10,359,179 B2
(45) Date of Patent: Jul. 23, 2019

(54) LIGHT SOURCE UNIT AND VEHICULAR LAMP

(71) Applicant: Koito Manufacturing Co., Ltd., Tokyo (JP)

(72) Inventors: Atsushi Ozawa, Shizuoka (JP); Yoshimasa Murata, Shizuoka (JP); Takuya Serita, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 15/715,244

(22) Filed: Sep. 26, 2017

(65) Prior Publication Data

US 2018/0106465 A1 Apr. 19, 2018

(30) Foreign Application Priority Data

Oct. 14, 2016 (JP) ..... 2016-202462

(51) Int. Cl.

| | |
|---|---|
| ***F21S 45/48*** | (2018.01) |
| ***F21V 19/00*** | (2006.01) |
| ***F21V 29/76*** | (2015.01) |
| ***F21V 17/10*** | (2006.01) |
| ***F21V 23/06*** | (2006.01) |
| ***F21K 9/90*** | (2016.01) |
| ***F21S 43/19*** | (2018.01) |
| ***F21S 43/14*** | (2018.01) |
| *F21Y 115/10* | (2016.01) |

(Continued)

(52) U.S. Cl.

CPC ..... *F21V 19/003* (2013.01); *F21K 9/90* (2013.01); *F21S 43/14* (2018.01); *F21S 43/19* (2018.01); *F21S 43/195* (2018.01); *F21S 45/48* (2018.01); *F21V 17/101* (2013.01); *F21V 23/06* (2013.01); *F21V 29/763* (2015.01); *F21S 45/50* (2018.01); *F21V 29/70* (2015.01); *F21Y 2115/10* (2016.08)

(58) Field of Classification Search

CPC ..... F21V 19/003; F21V 17/101; F21V 23/06; F21V 29/763; F21V 29/70; F21K 9/90; F21S 43/14; F21S 43/195; F21S 43/19; F21S 45/48; F21S 45/50; F21Y 2115/10

See application file for complete search history.

(56) References Cited

U.S. PATENT DOCUMENTS

| | | | | |
|---|---|---|---|---|
| 2015/0016136 | A1* | 1/2015 | Nakano | F21S 45/48 362/520 |
| 2016/0215948 | A1* | 7/2016 | Helbig | F21S 43/195 362/549 |
| 2018/0100643 | A1* | 4/2018 | Hino | F21V 23/06 362/549 |

FOREIGN PATENT DOCUMENTS

| | | | |
|---|---|---|---|
| JP | 2015-164121 | A | 9/2015 |

* cited by examiner

*Primary Examiner* — Y M. Lee
(74) *Attorney, Agent, or Firm* — Abelman, Frayne & Schwab

(57) ABSTRACT

A light source unit includes a board, a resin-molded unit formed using a resin material as a base material and having thermal conductivity, and a socket housing including a heat sink formed of a metal material, and a board attachment portion to which the board is attached and a covered surface which is covered with the resin-molded unit, wherein the resin-molded unit is formed with a holding hole communicating with the covered surface, and the heat sink and the resin-molded unit are formed by integral molding when a portion of the covered surface and a portion of the attachment surface are pressed by a portion of a mold inserted through the holding hole and another portion of the mold, respectively.

13 Claims, 12 Drawing Sheets

(51) Int. Cl.

| | |
|---|---|
| *F21V 29/70* | (2015.01) |
| *F21S 45/50* | (2018.01) |

LIGHT SOURCE UNIT AND VEHICULAR LAMP

CROSS-REFERENCE TO RELATED APPLICATIONS

This application is based on and claims priority from Japanese Patent Application No. 2016-202462, filed on Oct. 14, 2016 with the Japan Patent Office, the disclosure of which is incorporated herein in its entirety by reference.

TECHNICAL FIELD

The present disclosure relates to the technical field of a light source unit and a vehicular lamp having a socket housing and a board disposed in the socket housing.

BACKGROUND

A vehicular lamp is provided with, for example, a light source unit that is detachable from a housing outside a lamp that is configured with a lamp body and a cover, and a light emitting element such as, for example, a light emitting diode may be used as a light source of the light source unit.

As for the light source unit, a heat sink formed of a metal material and a resin-molded unit formed of a resin material may be integrally formed by, for example, insert molding (see, e.g., Japanese Patent Laid-open Publication No. 2015-164121). In the light source unit disclosed in Japanese Patent Laid-open Publication No. 2015-164121, the resin-molded unit is called a socket.

A board on which a light emitting element is mounted is attached to a heat sink, the heat generated when the light emitting element is emitted is transferred to the heat sink, and the temperature rise of the light emitting element and the board is suppressed to secure a good light emitting state of the light emitting element.

SUMMARY

In the above-described light source unit, since the board on which the light emitting element is mounted is attached to the heat sink, in order to determine the direction of light emitted from the light emitting element in a proper direction, it is required to ensure a high positional accuracy for the resin-molded unit of the heat sink.

By ensuring a high positional accuracy for the resin-molded unit of the heat sink, the direction of the light emitted from the light emitting element is in the proper direction, and a proper light distribution pattern may be ensured when a vehicle is running and the generation of dazzling light for passengers or pedestrians of opposite vehicles or preceding vehicles may be suppressed.

Thus, the present light source unit and vehicular lamp provide ensuring a high positional accuracy for the resin-molded unit of the heat sink by overcoming the above-described problem.

First, the light source unit according to the present disclosure includes a socket housing including a heat sink formed of a metal material and having a board attachment portion, and a resin-molded unit formed using a resin material and having thermal conductivity, a board attached to the board attachment portion, and a light emitting element mounted on the board and configured to function as a light source. The board attachment portion is formed with an attachment surface to which the board is attached and a covered surface which is at least partially covered with the resin-molded unit. A holding hole configured to communicate with the covered surface is formed in the resin-molded unit. In the socket housing, the heat sink and the resin-molded unit are formed by integral molding in a state in which a portion of the covered surface and at least a portion of the attachment surface are pressed by a portion of a mold inserted through the holding hole and another portion of the mold, respectively.

As a result, when the socket housing is molded, the attachment surface and the covered surface are pressed by each of portions of the mold.

Second, in the light source unit according to the present disclosure, the attachment surface and the covered surface may be formed as opposite surfaces on the board attachment portion.

As a result, the socket housing is formed in a state where the board attachment portion is pressed from the opposite side by each of portions of the mold.

Thirdly, in the light source unit according to the present disclosure, the board attachment portion may be formed to have a concave portion or a convex portion in a portion that communicates with the holding hole.

As a result, the heat sink is pressed in a state where a portion of the mold is engaged with the concave portion or the convex portion.

Fourthly, in the light source unit according to the present disclosure, the resin-molded unit may include a connector connecting portion in which a connection terminal is disposed to be connected to a connector, and the holding hole may be positioned inside the connector connecting portion.

As a result, the holding hole exists inside the connector connecting portion in which waterproofness and airtightness are ensured.

Fifthly, the light source unit according to the present disclosure relates to a vehicular lamp having a light source unit, the light source unit including a socket housing including a heat sink formed of a metal material and having a board attachment portion, and a resin-molded unit formed using a resin material as a base material and having thermal conductivity, a board attached to the board attachment portion, and a light emitting element mounted on the board and configured to function as a light source. The board attachment portion is formed with an attachment surface to which the board is attached and a covered surface which is at least partially covered with the resin-molded unit. A holding hole communicating with the covered surface is formed in the resin-molded unit. In the socket housing, the heat sink and the resin-molded unit are formed by integral molding in a state in which a portion of the covered surface and at least a portion of the covered surface are pressed by a portion of a mold inserted through the holding hole and another portion of the mold, respectively.

As a result, when the socket housing in the light source unit is molded, the attachment surface and the covered surface are pressed by each of portions of the mold.

Accordingly to the present disclosure, since the attachment surface and the covered surface are pressed by each of portions of the mold when the socket housing is molded, a high positional accuracy for the resin-molded unit of the heat sink may be ensured.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a cross-sectional view of a vehicular lamp, in which FIG. 1 illustrates an exemplary embodiment of the present disclosure together with FIGS. 2 to 13.

FIG. 8 is a cross-sectional view of a mold, in which FIG. 8 illustrates an example of a molding procedure of a socket housing together with FIGS. 9 to 13.

DETAILED DESCRIPTION

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

In the exemplary embodiment illustrated below, the present light source unit is applied to a light source unit that is used in a combination lamp having the functions of a stop lamp and a tail lamp, and the vehicular lamp of the present disclosure is applied to a vehicular lamp provided with this light source unit. However, the applicable scope of the present disclosure is not limited to the light source unit used in a combination lamp having the functions of a stop lamp and a tail lamp, and the vehicular lamp having the light source unit.

The present light source unit may be widely applied to light source units used in various vehicular lamps such as, for example, a head lamp, a clearance lamp, a tail lamp, a turn signal lamp, a stop lamp, a daytime running lamp, a cornering lamp, a hazard lamp, a position lamp, a back lamp, a fog lamp, or a combination lamp that is a combination of these lamps. The vehicular lamp of the present disclosure also may be widely applied to vehicular lamps provided with various light source units.

In the following description, forward, backward, upward, downward, leftward, and rightward directions are indicated herein, assuming that an optical axis direction is the forward and backward direction, a light emission direction is a backward direction. Further, the forward, backward, upward, downward, leftward, and rightward directions described below are used for convenience of explanation, and the implementation of the present disclosure is not limited to these directions.

Figure 1:
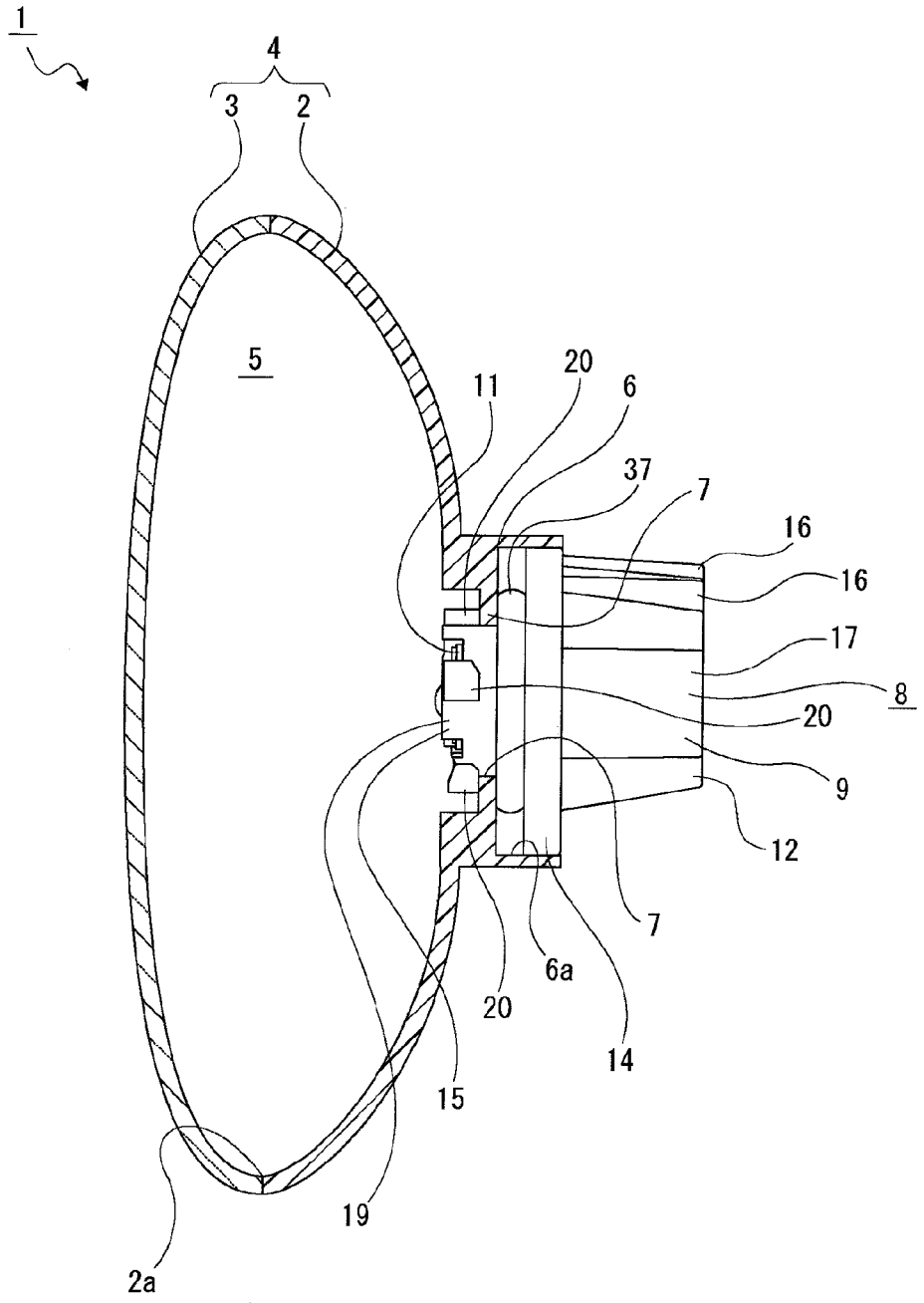

First, a schematic configuration of the vehicular lamp will be described (see, e.g., FIG. 1).

A vehicular lamp 1 is attached to each of the left and right end portions in the rear end of a vehicle body.

The vehicular lamp 1 is provided with a lamp body 2 having a backwardly opened concave portion and a cover 3 closing an opening 2*a* in the rear of the lamp body 2. An outer lamp housing 4 is constituted by the lamp body 2 and the cover 3, and the outer lamp housing 4 has an inner space that is formed as a lamp chamber 5.

A front end portion of the lamp body 2 is provided as a substantially cylindrical unit attachment portion 6 that penetrates back and forth, and the inner space of the unit attachment portion 6 is formed as an attachment hole 6*a*. Engaging protrusions 7, 7, . . . protruding inward are formed on the inner peripheral surface of the unit attachment portion 6 to be spaced apart from each other in the circumferential direction.

Subsequently, the structure of a light source unit 8 attached to the lamp body 2 will be described (see, e.g., FIGS. 2 to 7).

The light source unit 8 is detachably attached to the unit attachment portion 6 of the lamp body 2. The light source unit 8 has a socket housing 8, a power feeder 10, and a light emitting module 11.

The socket housing 9 is formed by integrally molding a resin-molded unit 12 and a heat sink 13. As for the integral molding, for example, so-called insert molding is used in which a molten resin (resin material) to be described later is filled in a state in which a metal material is held in a mold cavity, so that a molded article is integrally formed by the metal material and the resin material.

The resin-molded unit 12 is excellent in thermal conductivity and a resin material is used as a base material. Since the resin-molded unit 12 is formed in the state of containing, for example, carbon in the base material, the resin-molded unit also has conductivity. The resin-molded unit 12 includes a substantially disk-shaped base surface portion 14 directed in the forward and backward direction, a protrusion 15 protruding backward from the central portion of the base surface portion 14, first heat radiating fins 16, 16, . . . protruding forward from the base surface portion 14, second heat radiating fins 17 and 17 protruding forward from the base surface portion 14, and a connector connecting portion 18 protruding forward from the base surface portion 14.

The protrusion 15 includes a board arrangement portion 19 having a circular outer shape and engaging portions 20, 20, . . . provided on the outer peripheral surface of the board arrangement portion 19.

A backwardly opened arrangement concave portion 19*a* is formed in the board arrangement portion 19. The arrangement concave portion 19*a* is formed in a substantially rectangular shape and is slightly larger than the outer shape of the light emitting module 11. The engaging portions 20, 20, . . . are provided to be spaced apart from each other in the circumferential direction. The engaging portions 20, 20, . . . are positioned at the rear end portions of the board arrangement portion 19.

Figure 6:
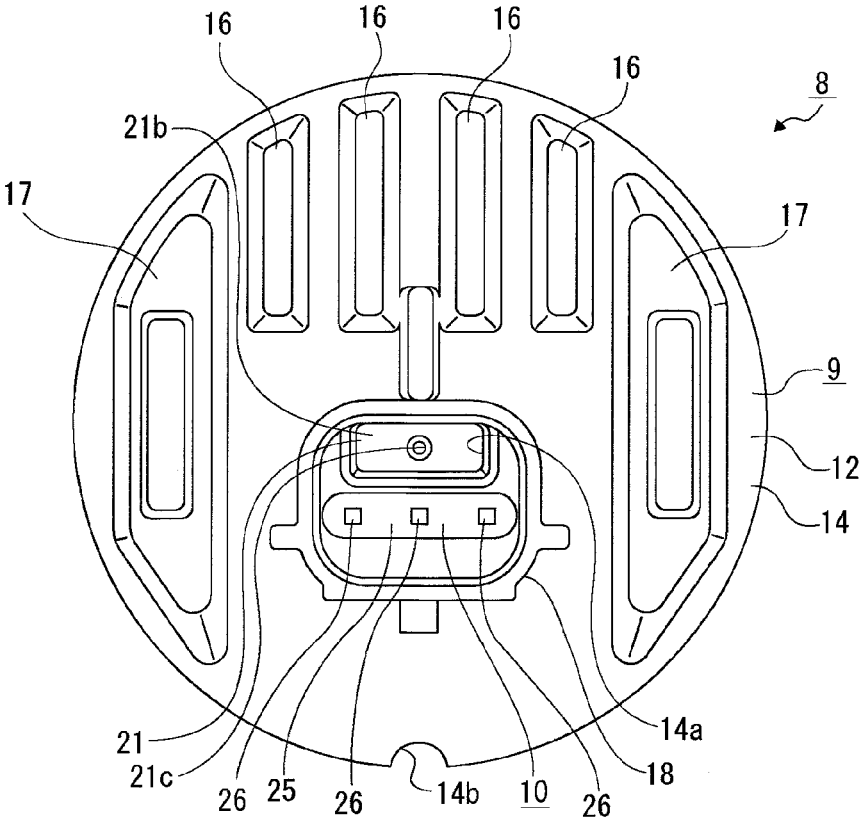
FIG. 6 is a front view of the light source unit.

The first heat radiating fins 16, 16, . . . are arranged side by side at equal intervals, for example, in the left and right direction and protrude from the upper half of the base surface portion 14 other than the left and right end portions thereof (see, e.g., FIG. 6).

The second heat radiating fins 17 and 17 are positioned on both sides of the first heat radiating fins 16, 16, . . . in the left and right direction and protrude from the left and right end portions of the base surface portion 14. The thicknesses of the second heat radiating fins 17 and 17 are greater than the thicknesses of the first heat radiating fins 16, 16, . . . in the left and right direction.

The connector connecting portion 18 is formed in a tubular shape whose axial direction is oriented in the forward and backward direction and is positioned below the first heat radiating fins 16, 16, . . . . The connector connecting portion 18 is waterproofed by, for example, a waterproof cap (not illustrated) in a state of being connected to a connector (not illustrated).

Figure 2:
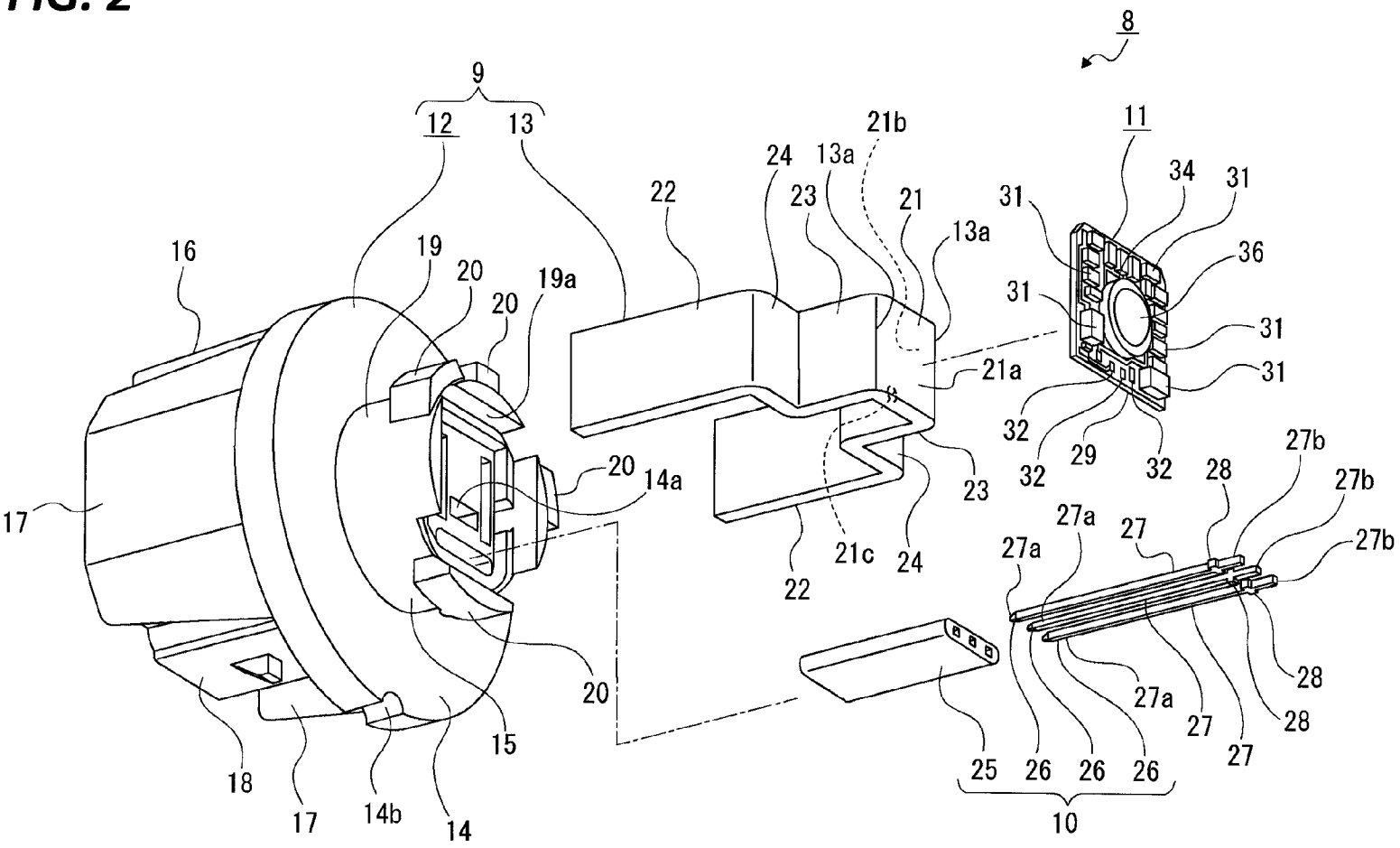
FIG. 2 is an exploded perspective view of a light source unit.
Figure 4:
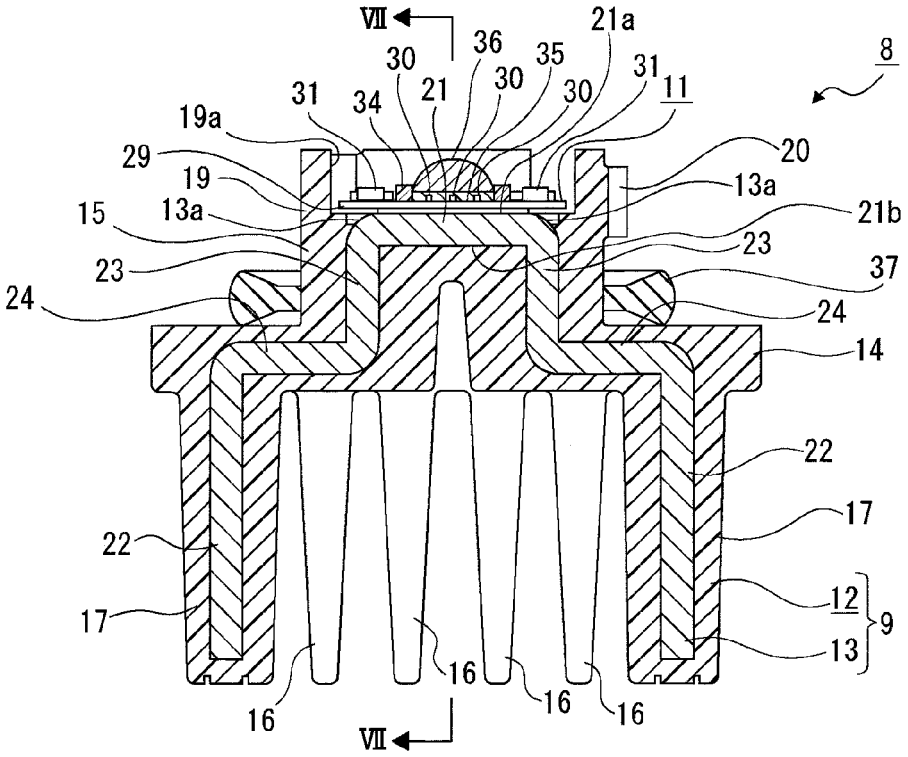
FIG. 4 is a cross-sectional view of the light source unit.

The heat sink 13 is formed of a plate-shaped metal material such as, for example, aluminum having a high thermal conductivity in a predetermined shape (see, e.g., FIGS. 2 and 4). The heat sink 13 includes a first heat radiating portion 21, second heat radiating portions 22 and 22, third heat radiating portions 23 and 23, and fourth heat radiating portions 24 and 24.

The first heat radiating portion 21 and the fourth heat radiating portions 24 and 24 are formed in a substantially rectangular shape oriented in the forward and backward direction, and the second heat radiating portions 22 and 22, and the third heat radiating portions 23 and 23 are formed in a substantially rectangular shape oriented in the left and right direction.

The first heat radiating portion 21 is provided as a board attachment portion. The rear face of the first heat radiating portion 21 is formed as an attachment surface 21*a* to which a board to be described later is attached, and the front face of the first heat radiating portion 21 is formed as a covered surface 21*b* covered with a resin-molded unit 12. A forwardly opened concave portion 21*c* is formed on the covered surface 21*b* side of the first heat radiating portion 21 (see, e.g., FIGS. 2 and 6).

As illustrated in FIGS. 2 and 4, the rear end portions of the third heat radiating portions 23 and 23 are connected to the left and right end portions of the first heat radiating portion 21, the inner end portions of the fourth heat radiating portions 24 and 24 are connected to the front end portions of the third heat radiating portions 23 and 23, and the outer end portions of the fourth heat radiating portions 24 and 24 are connected to the rear end portions of the second heat radiating portions 22 and 22. Thus, each of the third heat radiating portions 23 and 23 is formed by bending in a direction orthogonal to the first heat radiating portion 21, each of the fourth heat radiating portions 24 and 24 is formed by bending in a direction orthogonal to each of the third heat radiating portions 23 and 23, and each of the second heat radiating portions 22 and 22 is formed by bending in a direction orthogonal to each of the fourth heat radiating portions 24 and 24.

The first heat radiating portion 21 of the heat sink 13 is positioned in the arrangement concave portion 19*a* of the board arrangement portion 19 in the resin-molded unit 12, and the attachment surface 21*a* is exposed to the resin-molded unit 12 (see, e.g., FIG. 4). The second heat radiating portions 22 and 22 of the heat sink 13 are positioned inside the second heat radiating fins 17 and 17, respectively, a portion excluding the rear end portions of the third heat radiating portions 23 and 23 is positioned inside the board arrangement portion 19, and the fourth heat radiating portions 24 and 24 are positioned inside the base surface portion 14.

The resin-molded unit 12 is formed with an insertion arrangement hole (not illustrated) at a position from the board arrangement portion 19 to the base surface portion 14, and the insertion arrangement hole communicates with the insides of the arrangement concave portion 19*a* and the connector connecting portion 18.

Figure 7:
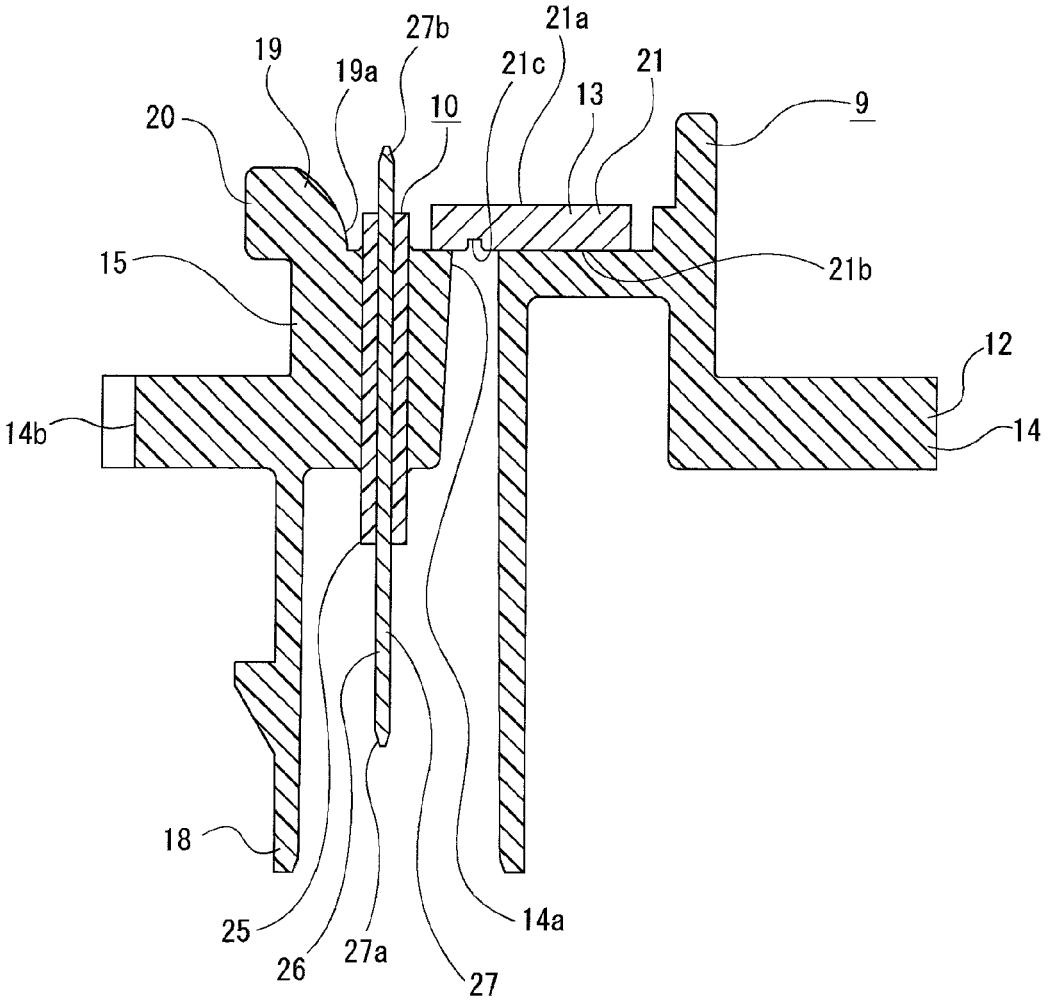
FIG. 7 is a cross-sectional view taken along line VII-VII in FIG. 4 in which a light emitting module and a gasket are removed.

The base surface portion 14 of the resin-molded unit 12 is formed with a holding hole 14*a* (see, e.g., FIGS. 2, 6, and 7). The holding hole 14*a* is formed inside the connector connecting portion 18 to communicate with the concave portion 21*c* formed in the first heat radiating portion 21 of the heat sink 13.

A positioning notch 14*b* is formed on the outer peripheral portion of the base surface portion 14. The positioning notch 14*b* is formed, for example, in the lower portion of the base surface portion 14 to be opened downward and penetrate back and forth.

A power feeder 10 includes a terminal holding portion 25 formed by an insulating resin material and connection terminals 26, 26, and 26 held by the terminal holding portion 25 and connected to the connector (see, e.g., FIG. 2).

The terminal holding portion 25 extends in the forward and backward direction and is formed in a flat shape that has a small thickness in the vertical direction.

The connection terminals 26, 26, and 26 are formed of a metal material and are positioned side by side inside the terminal holding portion 25 except for a portion thereof. Each connection terminal 26 includes a terminal portion 27 extending back and forth, and anti-fall-off protrusions 28 and 28 that protrude in the opposite direction from the position near the rear end of the terminal portion 27. The front end portion of the terminal portion 27 is provided as a connector connecting portion 27*a* and the rear end portion of the terminal portion 27 is provided as a wire connecting portion 27*b* connected to, for example, a wire. A surface processing, for example, by nickel or gold is performed on at least a portion of the wire connecting portion 27*b*.

The connector connecting portion 27*a* of the connection terminal 26 protrudes forward from the terminal holding portion 25 and the wire connecting portion 27*b* of the connection terminal 26 protrudes backward from the terminal holding portion 25. The connection terminal 26 is prevented from coming off in the forward and backward direction from the terminal holding portion 25 due to the anti-fall-off protrusions 28 and 28 being positioned inside the terminal holding portion 25.

The terminal holding portion 25 and the connection terminals 26, 26, and 26 of the power feeder 10 are integrally formed, for example, by insert molding. The portions other than the connector connecting portions 27*a*, 27*a*, and 27*a* and the wire connecting portions 27*b*, 27*b*, and 27*b* of the power feeder 10 are inserted into insertion arrangement holes formed in the resin-molded unit 12, the connector connecting portions 27*a*, 27*a*, and 27*a* are positioned inside the connector connecting portion 18 (see, e.g., FIG. 6), and the wire connecting portions 27*b*, 27*b*, and 27*b* are positioned in the arrangement convex portion 19*a* (see, e.g., FIG. 3).

The power feeder 10 is disposed in the cavity of the mold (to be described later) in a state of being formed, for example, by insert molding and is filled with a molten resin (to be described later) for forming the resin-molded unit 12 in the cavity, and the power feeder 10 is integrally formed, for example, by insert molding with the socket housing 9.

The light emitting module 11 includes a board 29 formed in a substantially rectangular shape oriented in the forward and backward direction, light emitting elements 30, 30, . . .

mounted on the board 29, and various control elements 31, 31, . . . mounted on the board 29 (see, e.g., FIGS. 2 to 5).

The board 29 is, for example, a ceramic board, and a wiring pattern is formed on the board 29 to supply electric current to the light emitting elements 30, 30, . . . . The size of the board 29 is substantially the same as the size of the first heat radiating portion of the heat sink 13.

For example, five light emitting elements 30, 30, . . . are mounted on the central portion of the board 29, and light emitting diodes (LEDs) are used as the light emitting elements 30, 30, . . . . Four light emitting elements 30, 30, . . . are mounted to be spaced apart from each other around one light emitting element 30 at equal intervals in the circumferential direction so that the central light emitting element 30 functions, for example, as a light source for a tail lamp and the four surrounding light emitting elements 30, 30, . . . function, for example, as light sources for a stop lamp.

The connection terminals 26, 26, and 26 are provided as a power supply terminal for a tail lamp, a power supply terminal for a stop lamp, and a power supply terminal for an earth, respectively.

Further, the number and function of the light emitting elements 30 mounted on the board 29 may be optionally set depending on, for example, the type of the vehicular lamp 1 and the required brightness.

For example, diodes, condensers, or resistors are used as the control elements 31, 31, . . . , and are mounted on the outside of the light emitting elements 30, 30, . . . in the light emitting module 11 to be connected to the wiring pattern, respectively.

The back face of the board 29 is attached to the surface of the first heat radiating portion 21 in the heat sink 13 by, for example, an adhesive. As for the adhesive, a thermally conductive and nonconductive adhesive is used.

Figure 3:
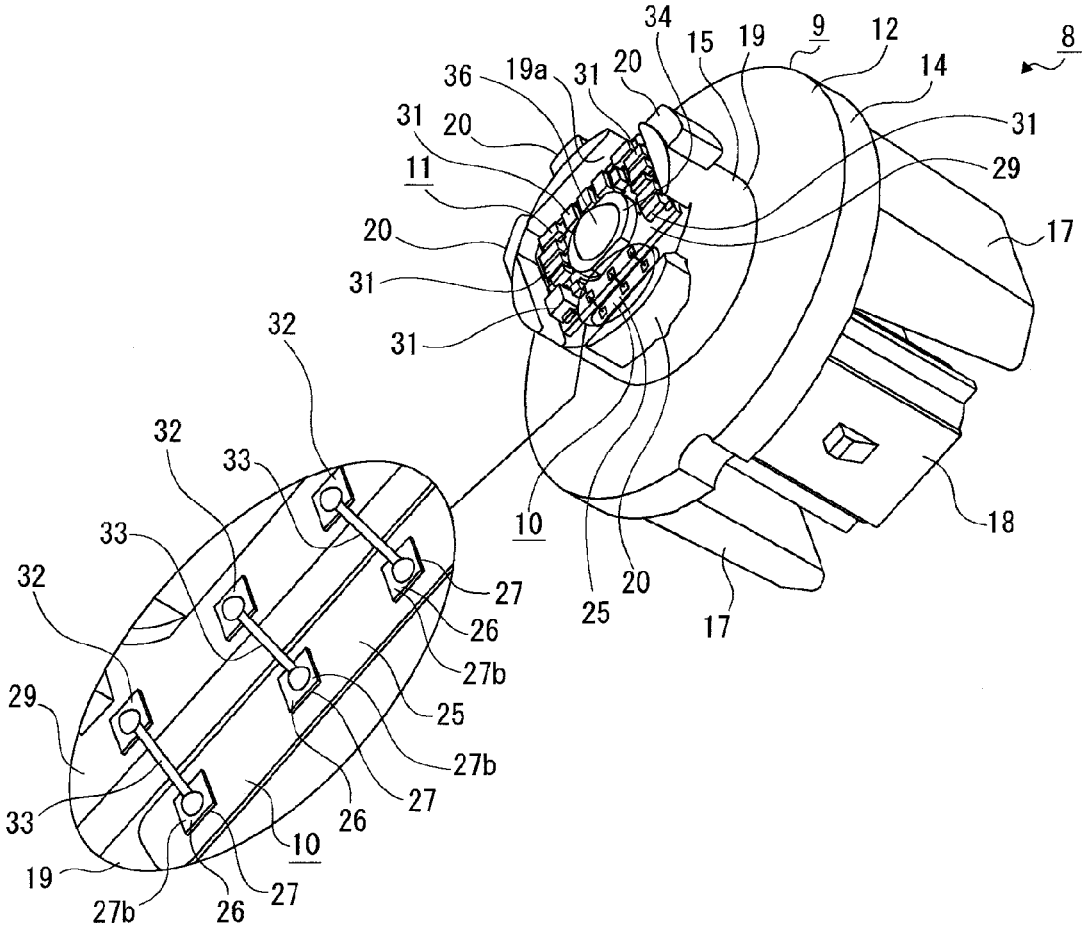
FIG. 3 is a perspective view of the light source unit.

Electrode pads 32, 32, and 32 connected to the wiring pattern are formed side by side at the lower portion of the board 29 (see, e.g., FIG. 3).

The electrode pads 32, 32, and 32 are positioned near the wire connecting portions 27*b*, 27*b*, and 27*b* in the connection terminals 26, 26, and 26, respectively.

The electrode pads 32, 32, and 32 are connected to the wire connecting portions 27*b*, 27*b*, and 27*b* of the connection terminals 26, 26, and 26 by wires 33, 33, and 33 formed by, for example, aluminum by soldering. The connection between the wire connecting portion 27*b* and the wire 33 is performed on the portion of the wire connecting portion 27*b* where a surface processing is performed by, for example, nickel or gold.

A frame 34 is attached to the board 29 between the light emitting elements 30, 30, . . . and the control elements 31, 31, . . . (see, e.g., FIGS. 3 to 5). The frame 34 is formed in a substantially annular shape, for example, by a resin material, and is disposed at a position surrounding the light emitting elements 30, 30, . . . .

A sealing portion 35 is disposed inside the frame 34, and the light emitting elements 30, 30, . . . are sealed by the sealing portion 35 (see, e.g., FIG. 4).

Figure 5:
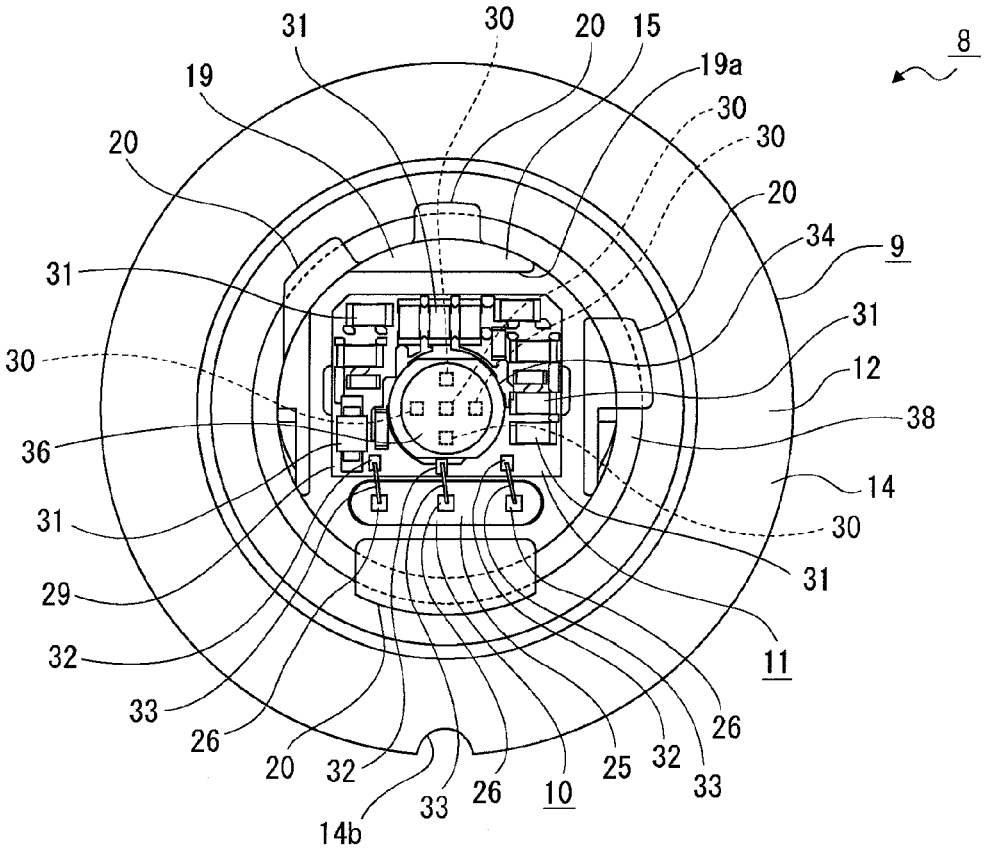
FIG. 5 is a rear view of the light source unit.

A lens portion 36 is disposed on the sealing portion 35 (see, e.g., FIGS. 3 to 5). The lens portion 36 is formed in a semispherical shape protruding backward using a predetermined molding resin.

In the light source unit 8 configured as described above, an annular gasket 37 is externally fitted to the protrusion 15 (see, e.g., FIG. 4). The gasket 37 is formed of a resin material or a rubber material. In a state where the gasket 37 is attached to the light source unit 8, the protrusion 15 is inserted into the unit attachment portion 6 of the lamp body 2 from the front side and is rotated in the circumferential direction so that the engaging portions 20, 20, . . . are engaged with the engaging protrusions 7, 7, . . . , respectively, from the back side (see, e.g., FIG. 1). At this time, the engaging protrusions 7, 7, . . . are sandwiched between the engaging portions 20, 20, . . . and the gasket 37, and the light source unit 8 is attached to the lamp body 2. In a state where the light source unit 8 is attached to the lamp body 2, the unit attachment portion 6 is closed by the gasket 37 so that the intrusion of foreign matters such as, for example, moisture into the lamp chamber 5 via the unit attachment portion 6 from the outside is prevented.

On the contrary, when the light source unit 8 is rotated in the opposite direction to the above-mentioned direction in the circumferential direction, the connection of the engaging portions 20, 20, . . . with the engaging protrusions 7, 7, . . . is disengaged and the light source unit 8 may be removed from the lamp body 2 by pulling out the protrusion 15 from the unit attachment portion 6.

When a current is supplied to a wiring pattern from a power supply circuit through the connector and the connection terminals 26, 26, and 26 in a state where the light source unit 8 is attached to the lamp body 2, light is emitted from at least one light emitting element 30. In this case, when the vehicular lamp 1 functions as a tail lamp, light is emitted from one light emitting element 30 positioned at the center, and when the vehicular lamp 1 functions as a stop lamp, light is emitted from four light emitting elements 30, 30, . . . other than those positioned at the center.

The light emitted from the light emitting element 30 transmits through the sealing portion 35 and the lens portion 36 and is irradiated to the outside through the cover 3. At this time, the irradiating direction of light is controlled by the lens portion 36 and light is irradiated to the outside toward a predetermined direction.

Heat is generated in the light emitting module 11 during the light emission from the light emitting element 30, and the generated light is transferred to the first heat radiating portion 21 through an adhesive having excellent thermal conductivity and then transferred to the heat sink 13 and the resin-molded unit 12. The heat transferred to the heat sink 13 and the resin-molded unit 12 is released to the outside mainly from the first heat radiating fins 16, 16, . . . and the second heat radiating fins 17 and 17.

Subsequently, descriptions will be made on an example of a molding procedure of the socket housing 9 (see, e.g., FIGS. 8 to 13).

Figure 8:
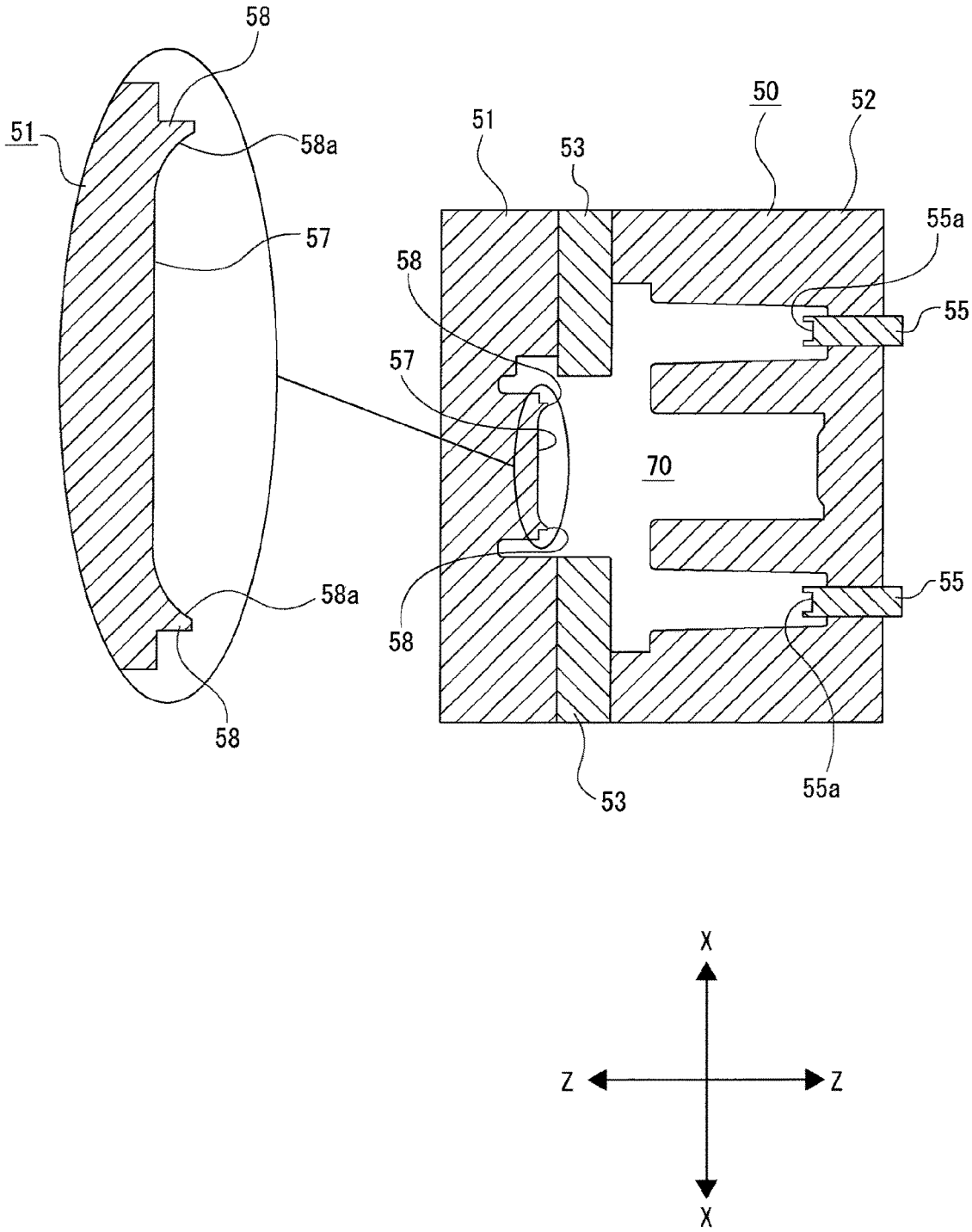
Figure 9:
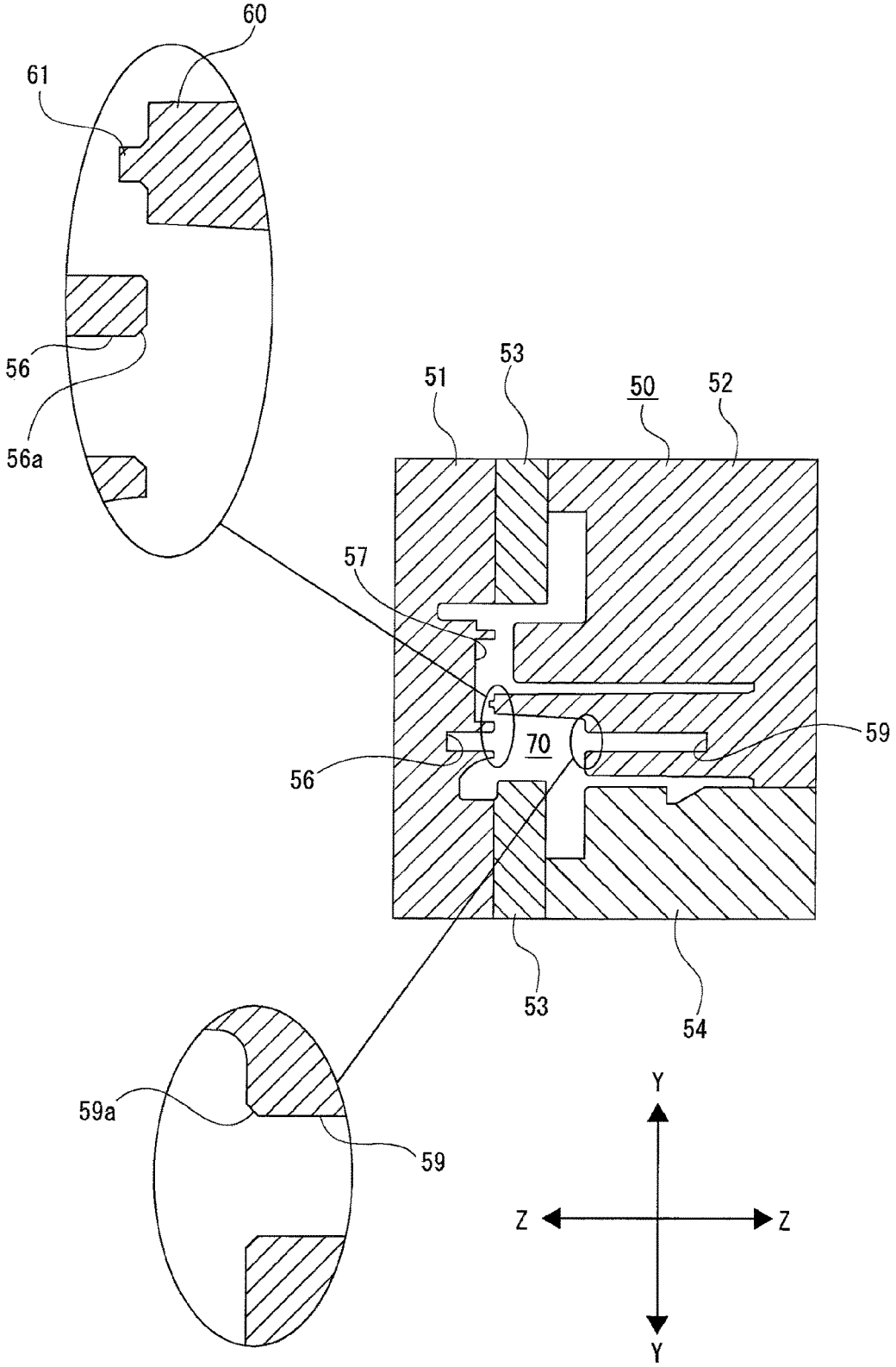
FIG. 9 is a cross-sectional view of the mold, which is viewed in a direction orthogonal to that of FIG. 8.

First, the configuration of a mold 50 for molding the socket housing 9 will be described (see, e.g., FIGS. 8 and 9).

The mold 50 includes a core mold 51, a cavity mold 52, first sliders 53 and 53, and a second slider 54. The core mold 51 is a mold that is movable with respect to the cavity mold 52 in the forward and backward direction (the Z direction illustrated in FIGS. 8 and 9), and the cavity mold 52 is a fixed mold. The core mold 51 and the cavity mold 52 are engaged with the first sliders 53 and 53, and the first sliders 53 and 53 are movable in a direction to be separated from/brought into contact with each other between the core mold 51 and the cavity mold 52 in the lateral direction (the X direction illustrated in FIG. 8). The second slider 54 is movable in the vertical direction (the Y direction illustrated in FIG. 9) on the lower side of the cavity mold 52 and the front side of the first slider 53, and is engaged with the cavity mold 52 in a state of being moved to the upper movable end portion.

Movable pieces 55 and 55 movable in the forward and backward direction are supported on the front end portion of the cavity mold 52 in a state of being vertically spaced art. A backwardly opened positioning recess 55*a* is formed at the rear end portion of each movable piece 55.

The core mold 51 is formed with a forwardly opened insertion recess 56. The opening edge of the insertion recess 56 is formed with a sloped surface having a chamfered shape, and the sloped surface is formed as a guide surface 56*a*. A pressing surface 57 facing forward is formed at the center of the core mold 51.

In the core mold 51, pushing protrusions 58 and 58 protruding forward and extending vertically are provided to be laterally spaced apart from each other. The mutually facing surfaces of the pushing protrusions 58 and 58 are formed as concave curved surfaces continuous to the pressing surface 57, and these curved surfaces are formed as abutment surfaces 58*a* and 58*a*. The curvatures of the abutment surfaces 58*a* and 58*a* are set to be the same as the curvatures of curved surfaces 13*a* and 13*a* which are the outer surfaces in the continuous portions of the first heat radiating portion 21 and the third heat radiating portion 23 of the heat sink 13, respectively.

The cavity mold 52 is formed with a backwardly opened insertion recess 59. The insertion recess 59 is formed right in front of the insertion recess 56 formed in the core mold 51. The opening edge of the insertion recess 59 is formed with a sloped surface having a chamfered shape, and the sloped surface is formed as a guide surface 59*a*.

A protrusion 60 is formed in the cavity mold 52 to protrude backward. An insertion protrusion 61 protrudes backward from the rear face of the protrusion 60.

Figure 10:
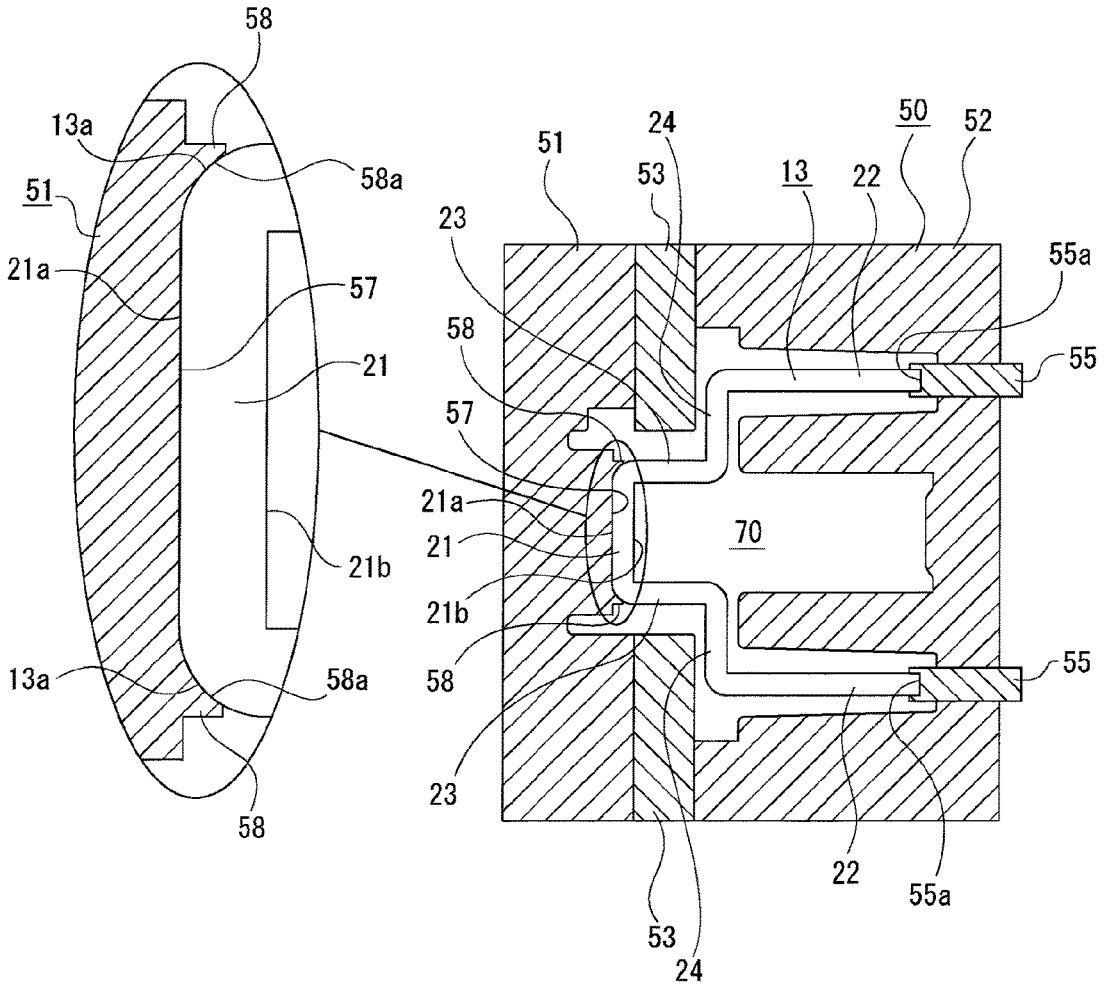
FIG. 10 is a cross-sectional view illustrating a state before a cavity is filled with a molten resin.
Figure 11:
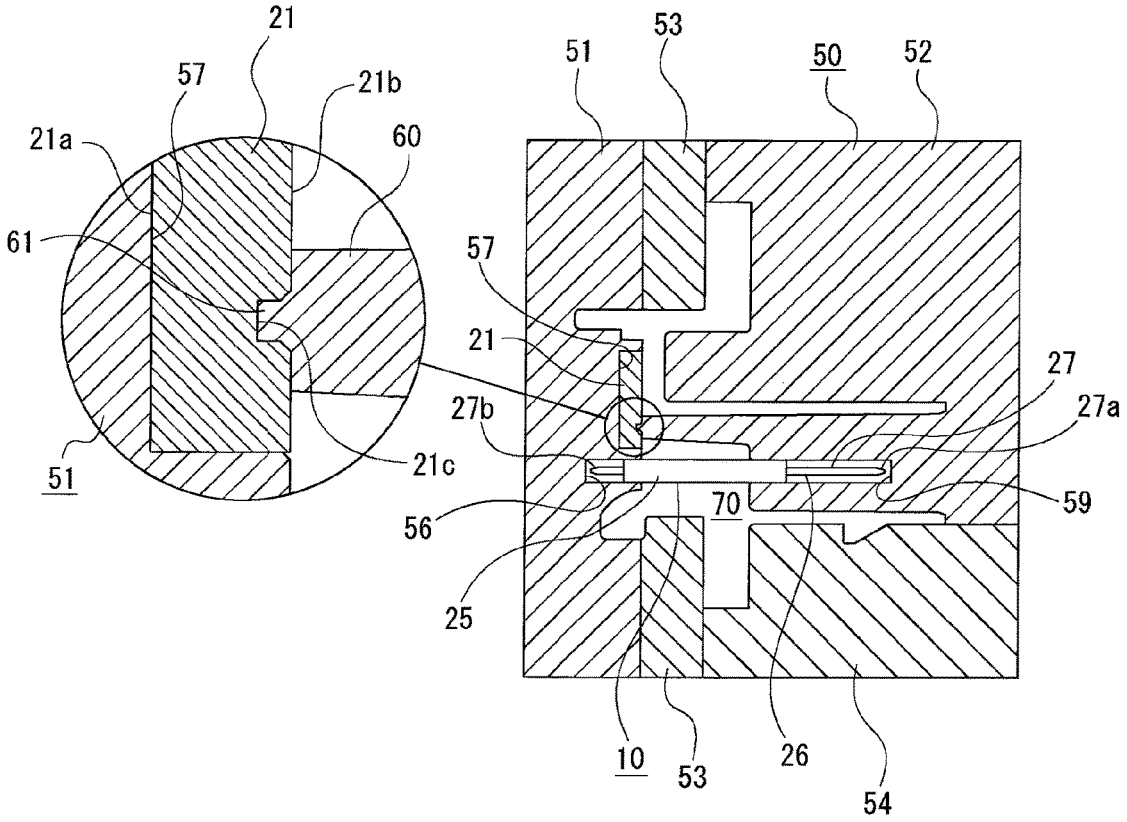
FIG. 11 is a cross-sectional view of a state before the cavity is filled with the molten resin, which is viewed in a direction orthogonal to that of FIG. 8.

A heat sink 13 is disposed in a cavity 70 of the mold 50 configured as described above (see, e.g., FIGS. 10 and 11).

In a state where the heat sink 13 is disposed in the cavity 70, the attachment surface 21*a* of the first heat radiating portion 21 is pressed from the rear side by the pressing surface 57 of the core mold 51. At this time, the curved surfaces 13*a* and 13*a* of the heat sink 13 are pressed by the abutment surfaces 58*a* and 58*a* of the pushing protrusions 58 and 58, respectively (see, e.g., FIG. 10). Further, the insertion protrusion 61 of the cavity mold 52 is inserted into the concave portion 21*c* of the first heat radiating portion 21, and the covered surface 21*b* is pressed from the front side by the front end surface of the protrusion 60 (see, e.g., FIG. 11).

Thus, the heat sink 13 is pressed by the pressing surface 57 and the protrusion 60 in the forward and backward direction, and is held by the core mold 51 and the cavity mold 52 in the cavity 70 (see, e.g., FIGS. 10 and 11).

The movable pieces 55 and 55 are positioned at the rear movable end portion in a state where the heat sink 13 is held by the core mold 51 and the cavity mold 52, and the front end portions of the second heat radiating portions 22 and 22 are inserted into the positioning recesses 55*a* and 55*a*, respectively (see, e.g., FIG. 10). Thus, the movable pieces 55 and 55 are pushed from the front end surfaces of the second heat radiating portions 22 and 22, respectively, and the heat sink 13 is held and positioned by the movable pieces 55 and 55 in addition to the core mold 51 and the cavity mold 52 in the cavity 70.

As described above, the curved surfaces 13*a* and 13*a* in the continuous portions of the first heat radiating portion 21 and the third heat radiating portions 23 and 23 of the heat sink 13 are pressed by the abutment surfaces 58*a* and 58*a* of the pressing protrusions 58 and 58, respectively, in a state where the heat sink 13 is pressed by the core mold 51 and the cavity mold 52.

In this way, the pressing protrusions 58 do not come into contact with a flat surface (outer surface) of the third heat radiating portions 23 and 23 facing the left and right direction, but the abutment surfaces 58*a* come into contact with only the curved surfaces 13*a*. In a case where the pressing protrusions 58 are in contact with the flat surfaces facing the left and right direction of the second heat radiating portions 22 and 22, a gap occurs between the abutment surfaces 58*a* and the curved surfaces 13*a*, and as a result, the molten resin may infiltrate into the gap. However, since the pressing protrusions 58 are formed in a shape in which the abutment surfaces 58*a* are in contact with only the curved surfaces 13*a*, no gap occurs between the abutment surfaces 58*a* and the curved surfaces 13*a*.

In this way, since the pressing protrusions 58 are formed in a shape in which the abutment surfaces 58*a* are in contact with only the curved surfaces 13*a* and no space occurs between the abutment surfaces 58*a* and the curved surfaces 13*a*. Thus, since there is no concern that the molten resin infiltrates into a gap between the attachment surfaces 21*a* and the pressing surfaces 57 of the heat sink 13, a good attachment state of the board 29 with respect to the attachment surface 21*a* may be secured.

In addition, a power feeder 10 integrally formed with a terminal holding portion 25 and connection terminals 26, 26, and 26 is disposed in the cavity 70 (see, e.g., FIG. 11).

The front end portion of the power feeder 10 is inserted into the insertion recess 59 of the cavity mold 52 from the rear side. In this case, since a guide surface 59*a*, which is a sloped surface, is formed in the opening edge of the insertion recess 59, the front end edge of the terminal holding portion 25 is guided to the guide surface 59*a* and the front end portion of the terminal holding portion 25 is fitted into the insertion recess 59.

Since the guide surface 59*a* is formed in the opening edge of the insertion recess 59 in the cavity mold 52, the front end portion of the terminal holding portion 25 may be securely fitted into the insertion recess 59 by smoothly inserting the terminal holding portion 25 into the insertion recess 59.

When the core mold 51 is moved forward and the core mold 51 and the cavity mold 52 are closed, the rear end portion of the power feeder 10 is inserted into the insertion recess 56 of the core mold 51 from the front side. In this case, since a guide surface 56*a*, which is a sloped surface, is formed in the opening edge of the insertion recess 56, the rear end edge of the terminal holding portion 25 is guided to the guide surface 56*a* and the rear end portion of the terminal holding portion 25 is fitted into the insertion recess 56.

Since the guide surface 56*a* is formed in the opening edge of the insertion recess 56 in the cavity mold 51, the rear end portion of the terminal holding portion 25 may be securely fitted into the insertion recess 56 by smoothly inserting the terminal holding portion 25 into the insertion recess 56.

Further, since the front and rear end portions of the terminal holding portion 25 are inserted into the insertion recesses 59 and 56 in the guide surfaces 59*a* and 56*a*, respectively, the connection terminals 26, 26, and 26 do not come into contact with the core mold 51 and the cavity mold 52 so that the power feeder 10 may prevent scratching of the connection terminals 26, 26, and 26 and peeling of the surface treatment metal such as nickel or gold from the connection terminals 26, 26, and 26.

Figure 12:
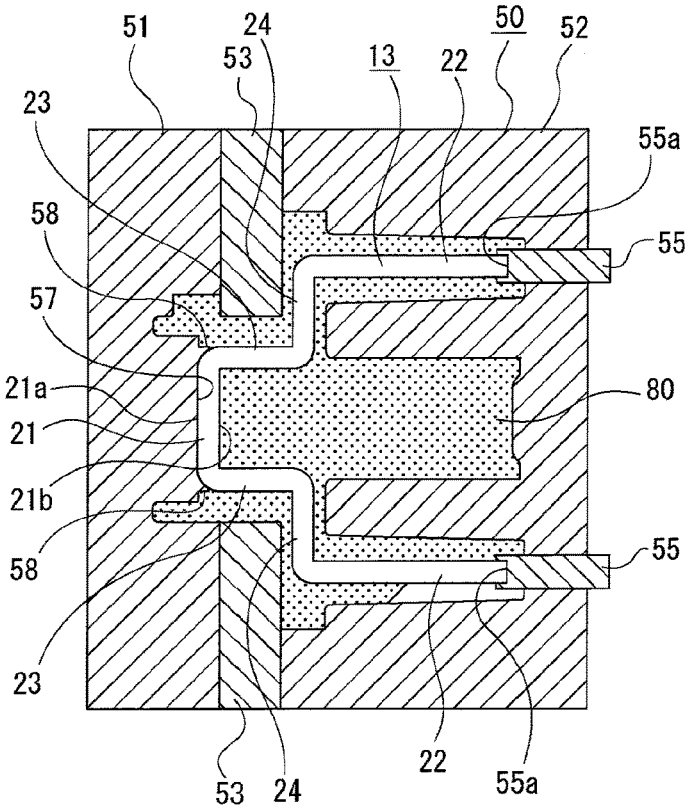
FIG. 12 is a cross-sectional view illustrating a state in which the cavity is filled with the molten resin.

In a state where the heat sink 13 and the power feeder 10 are disposed in the cavity 70 as described above, the molten resin 80 is filled in the cavity 70 from the gate (not illustrated) (see, e.g., FIG. 12).

When the cavity 70 is filled with molten resin 80, the molten resin 80 covers the portion of the heat sink 13 except for a portion thereof. That is, the heat sink 13 is covered with the molten resin at portions other than the portions, which are in contact with the core mold 51, the cavity mold 52, and the movable pieces 55 and 55.

Figure 13:
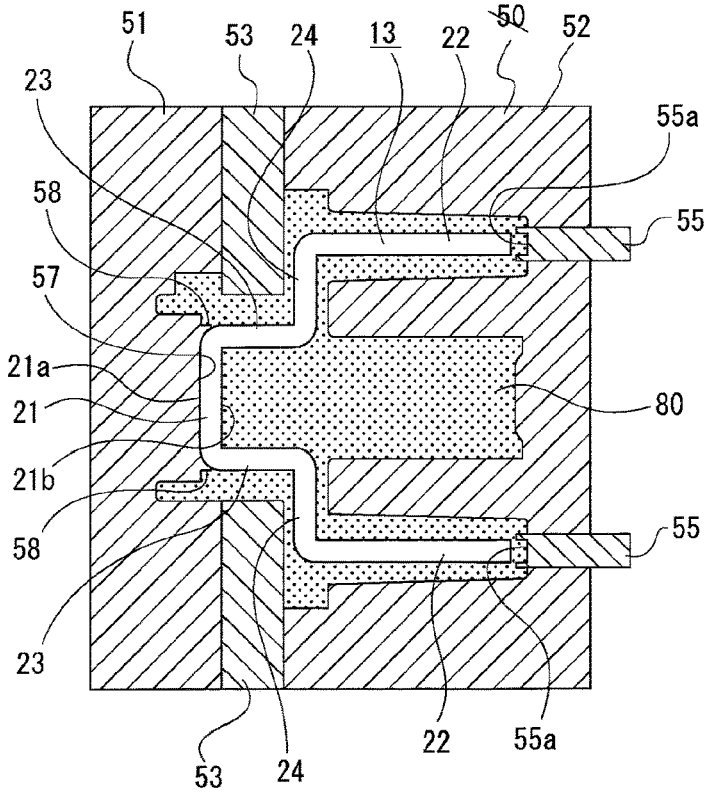
FIG. 13 is a cross-sectional view illustrating a state in which the cavity is filled with the molten resin.

Subsequently, immediately before the filling of the molten resin 80 into the cavity 70 is completed, the movable pieces 55 and 55 are moved in a direction away from the second heat radiating portions 22 and 22 of the heat sink 13 (see, e.g., FIG. 13).

The movable pieces 55 and 55 are moved in a direction away from the heat sink 13 to release the state of holding the front end portions of the second heat radiating portions 22 and 22 by the movable pieces 55 and 55. At this time, since the cavity 80 is filled with the molten resin 70, the molten resin 80 covers the front end portion of the second heat radiating portions 22 and 22.

Subsequently, the filling of the molten resin 80 into the cavity 70 is stopped, and the molten resin 80 is cooled and solidified. When the molten resin 80 is cooled and solidified, the molten resin 80 is formed as the resin-molded unit 12, and the resin-molded unit 12 and the heat sink 13 are integrally formed as the socket housing 9 by insert molding. As the core mold 51, the cavity mold 52, the first sliders 53 and 53, and the second slider 54 are opened, the formed socket housing 9 is taken out of the mold 50.

As described above, since the heat sink 13 is held by the pressing surface 57 of the core mold 51, the protrusion 60 of the cavity mold 52, and the movable pieces 55 and 55 in the cavity 70, when the cavity 70 is filled with the molten resin 80, a good moldability of the socket housing 9 may be ensured without any misalignment.

Further, the heat sink 13 is held by the movable pieces 55 and 55 while the movable pieces 55 are also moved by the movable pieces 55 and 55 in the heat sink 13. As a result, the portion held by the movable pieces 55 and 55 is covered with the molten resin 80 so as to ensure a high moldability of the socket housing 9.

In addition, since the entire second heat radiating portions 22 and 22 of the heat sink 13 are covered by the resin-molded unit 12, moisture or gas does not infiltrate into a gap between the second heat radiating portions 22 and 22 and the resin-molded unit 12 so that high waterproofness and airtightness of the socket housing 9 may be ensured.

The light emitting module 11 is attached, by adhesion, to the socket housing 9 taken out of the mold 50. The board 29 is attached to the attachment surface 21*a* of the heat sink 13. The attachment of the board 29 is performed in a state where a positioning jig (not illustrated) is inserted into a positioning notch 14*b* formed on the base surface portion 14.

The positioning jig is inserted into the positioning notch 14*b* so that the socket housing 9 is not rotated in the circumferential direction of the base surface portion 14 but held in a predetermined direction. Therefore, the direction of the board 29 with respect to the socket housing 9 may be made constant, and the board 29 may be attached to the socket housing 9 in a proper direction.

As described above, in the light source unit 8 and the vehicular lamp 1 provided with the light source unit 8, the socket housing 9 is configured such that the heat sink 13 and the resin-molded unit 12 are formed by integral molding in a state in which a portion of the covered surface 21*b* and at least a portion of the attachment surface 21*a* are pressed by a portion of a mold 50 inserted through the holding hole 14*a* and another portion of the mold 50, respectively.

Thus, since the attachment surface 21*a* and the covered surface 21*b* are pressed by each of portions of the mold 50 when the socket housing 9 is molded, a high positional accuracy for the resin-molded unit 12 of the heat sink 13 may be ensured.

In addition, the attachment surface 21*a* and the covered surface 21*b* are formed as opposite surfaces in the first heat radiating portion 21 that functions as a board attachment portion.

Thus, the socket housing 9 is formed in a state where the first heat radiating portion 21 is pressed from the opposite side by respective portions of the mold 50. Therefore, the high positional accuracy of the heat sink 13 for the resin-molded unit 12 of the socket housing 9 is ensured and the high moldability of the light source unit 8 may be ensured.

In addition, a concave portion 21*c* is formed in a portion communicating with the holding hole 14*a* in the first heat radiating portion 21 that functions as a board attachment portion.

Therefore, since the heat sink 13 is pressed in a state where a portion of the mold 50 is inserted into the concave portion 21*c*, the heat sink 13 is pressed in a stable state by the mold 50 so that the high positional accuracy of the heat sink 13 for the resin-molded unit 12 of the socket housing 9 may be ensured.

Further, an example where the concave portion 21*c* is formed in the first heat radiating portion 21 has been described above. On the contrary, the convex portion may be formed in the first heat radiating portion and the concave portion may be formed in the protrusion of the mold so that the convex portion of the first heat radiating portion may be inserted into the concave portion of the protrusion. In this case, the heat sink 13 is also pressed in a stable state by the mold and a high positional accuracy of the heat sink 13 with respect to the resin-molded unit 12 of the socket housing 9 may be ensured.

Moreover, the holding hole 14*a* is positioned inside the connector connecting portion 18.

Therefore, since the holding hole 14*a* exists inside the connector connecting portion 18 that secures waterproofness and airtightness, waterproofness and airtightness of the heat sink 13 may be ensured without using an exclusive waterpoofing unit or airtighting unit.

Further, the heat sink 13 is provided with the first heat radiating portion 21 that comes into contact with the board 29, the resin-molded unit 12 is provided with the first heat radiating fins 16, 16, . . . and the second heat radiating fins 17 and 17, and the socket housing 9 is formed by integrally molding the heat sink 13 and the resin-molded unit 12.

Accordingly, since heat is radiated from the heat sink 13 formed by a metal material and the resin-molded unit 12 formed using a resin material as the base material when the light is emitted from the light emitting element 30, it is possible to improve heat radiation property from the light emitting element 30 at the time of light emission.

In addition, since the socket housing 9 is formed by the resin-molded unit 12 and the heat sink 13, and as a result, the entire socket housing 9 is not configured by the heat sink, it is possible to reduce a manufacturing cost and improve heat radiation property during the light emission from the light emitting element 30.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A light source unit comprising:

a socket housing including a heat sink formed of a metal material and having a board attachment portion, and a resin-molded unit formed using a resin material as a base material and having thermal conductivity;

a board attached to the board attachment portion; and a light emitting element mounted on the board and configured to function as a light source, wherein the board attachment portion is formed with an attachment surface to which the board is attached and a covered surface which is at least partially covered with the resin-molded unit, a holding hole in which a portion of the covered surface is exposed is formed in the resin-molded unit, and in the socket housing, the heat sink and the resin-molded unit are formed by integral molding in a state in which the portion of the covered surface and at least a portion of the attachment surface are pressed by a portion of a mold inserted through the holding hole and another portion of the mold, respectively.

2. The light source unit of claim 1, wherein the attachment surface and the covered surface are formed as opposite surfaces on the board attachment portion.

3. The light source unit of claim 2, wherein a concave portion or a convex portion is formed on the portion of the covered surface of the board attachment portion exposed through the holding hole.

4. The light source unit of claim 3, wherein the resin-molded unit includes a connector connecting portion in which a connection terminal is disposed to be connected to a connector, and the holding hole is positioned inside the connector connecting portion.

5. The light source unit of claim 2, wherein the resin-molded unit includes a connector connecting portion in which a connection terminal is disposed to be connected to a connector, and the holding hole is positioned inside the connector connecting portion.

6. The light source unit of claim 1, wherein a concave portion or a convex portion is formed on the portion of the covered surface of the board attachment portion exposed through the holding hole.

7. The light source unit of claim 6, wherein the resin-molded unit includes a connector connecting portion in which a connection terminal is disposed to be connected to a connector, and the holding hole is positioned inside the connector connecting portion.

8. The light source unit of claim 1, wherein the resin-molded unit includes a connector connecting portion in which a connection terminal is disposed to be connected to a connector, and the holding hole is positioned inside the connector connecting portion.

9. The light source unit of claim 1, wherein a positioning notch is formed on an outer peripheral portion of the resin-molded unit.

10. A vehicular lamp comprising:

a light source unit, wherein the light source unit includes:

a socket housing including a heat sink formed of a metal material and having a board attachment portion, and a resin-molded unit formed using a resin material as a base material and having thermal conductivity;

a board attached to the board attachment portion; and a light emitting element mounted on the board and configured to function as a light source, wherein the board attachment portion is formed with an attachment surface to which the board is attached and a covered surface which is at least partially covered with the resin-molded unit, a holding hole in which a portion of the covered surface is exposed is formed in the resin-molded unit, and in the socket housing, the heat sink and the resin-molded unit are formed by integral molding in a state in which the portion of the covered surface and at least a portion of the attachment surface are pressed by a portion of a mold inserted through the holding hole and another portion of the mold, respectively.

11. The vehicular lamp of claim 10, wherein a positioning notch is formed on an outer peripheral portion of the resin-molded unit.

12. A light source unit comprising:

a socket housing including a heat sink formed of a metal material and having a board attachment portion, and a resin-molded unit formed using a resin material as a base material and having thermal conductivity;

a board attached to the board attachment portion; and a light emitting element mounted on the board and configured to function as a light source, wherein the board attachment portion is formed with an attachment surface to which the board is attached and a covered surface which is at least partially covered with the resin-molded unit, a holding hole configured to communicate with the covered surface is formed in the resin-molded unit, in the socket housing, the heat sink and the resin-molded unit are formed by integral molding in a state in which a portion of the covered surface and at least a portion of the attachment surface are pressed by a portion of a mold inserted through the holding hole and another portion of the mold, respectively, the resin-molded unit includes a connector connecting portion in which a connection terminal is disposed to be connected to a connector, and the holding hole is positioned inside the connector connecting portion.

13. The light source unit of claim 12, wherein a positioning notch is formed on an outer peripheral portion of the resin-molded unit.

* * * * *